United States Patent [19]

Zafferri et al.

[11] 4,258,432

[45] Mar. 24, 1981

[54] ELECTRO-ACOUSTIC DEVICE FOR ALARM WATCH

[75] Inventors: Roberto Zafferri, Lugano; Laurent Grosjean, Neuchatel, both of Switzerland

[73] Assignee: Ebauches S.A., Neuchatel, Switzerland

[21] Appl. No.: 87,967

[22] Filed: Oct. 25, 1979

[30] Foreign Application Priority Data

Nov. 10, 1978 [CH] Switzerland ..... 11582/78

[51] Int. Cl.[3] ..... G04C 21/16

[52] U.S. Cl. ..... 368/250

[58] Field of Search ..... 58/19 R, 38 R, 38 A, 58/57.5, 152 B; 340/384 E; 368/250

[56] References Cited

U.S. PATENT DOCUMENTS

| | | | |
|---|---|---|---|
| 3,577,876 | 5/1971 | Spadini | 58/57.5 |
| 3,732,686 | 5/1973 | Zaugg | 58/57.5 |
| 3,863,437 | 2/1975 | Barth et al. | 58/57.5 |
| 3,974,499 | 8/1976 | Shigemori et al. | 340/384 E |
| 4,167,849 | 9/1979 | Yakahashi | 58/57.5 |

*Primary Examiner*—Vit W. Miska

*Attorney, Agent, or Firm*—Silverman, Cass & Singer, Ltd.

[57] ABSTRACT

An electro-acoustic device for an alarm watch includes a lever moved by an oscillating electromagnetic field created by an electromagnet to vibrate a moving element or glass of the watch and produce a sound. The glass is elastically mounted on a sealing ring of the watch. The lever is mounted by one end to the watch and includes a tapered part adjacent the one end which is elastically deformable thereat so that a free end ot the lever opposite the one end may vibrate and its fundamental frequency in response to the oscillating electromagnetic field. The free end of the lever carries a stem coupling the lever to the glass and transmitting the oscillating motion of the lever to the glass, which vibrates on the elastic ring to produce the sound.

9 Claims, 2 Drawing Figures

ELECTRO-ACOUSTIC DEVICE FOR ALARM WATCH

BACKGROUND OF THE INVENTION

This invention relates to an electro-acoustic device. Electro-acoustic devices for alarm watches are known. They generally comprise an electromagnet, a hammer, and a sound generating member, which could be a glass or crystal or a casing of the watch. Actuated by the electromagnet, the hammer strikes a part of the glass which vibrates at its fundamental frequency. Since this fundamental frequency is quite different from the frequency at which the hammer strikes, the efficiency of the device is rather poor, a great amount of energy being lost. Besides the electro-acoustic device can only generate sound at a frequency corresponding to the fundamental frequency and the harmonics of the glass; thus it does not have the possibility of generating sounds at different tones allowing, for example, to differentiate between two kinds of alarms by two different notes.

An object of the present invention is to correct these drawbacks and to propose an improved electro-acoustic device. To make the performance of such a device satisfactory, the movable oscillating element should not only vibrate at its fundamental frequency and its harmonics, but should be able to oscillate at the frequency produced by the electromagnet. This objective is obtained by the means outlined in the claims herein.

Another object of the invention is to provide an electro-acoustic device able to give a clear and loud enough to be heard sound.

A further object of the invention is to provide an electro-acoustic device able to generate sounds of different tones and to play musical tunes.

Still another object of the invention is to provide an electro-acoustic device where the loudness of the sound can be maximized.

SUMMARY OF THE INVENTION

In accordance with the invention there is a lever including a flexible end, a free end opposite the flexible end and a portion including magnetic material. The flexible end is mounted on a watch base and the portion including magnetic material is actuated by an oscillating electro-magnetic field created by an electromagnet to oscillate the free end at a maximum amplitude. Sound generating structure such as a watch glass is coupled to the free end and vibrates to produce sound in response to the oscillations of the lever.

BRIEF DESCRIPTION OF THE DRAWING

As an example, the drawing shows one possible configuration of the object of this invention.

DESCRIPTION OF THE PREFERRED EMBODIMENT

Figure 1:
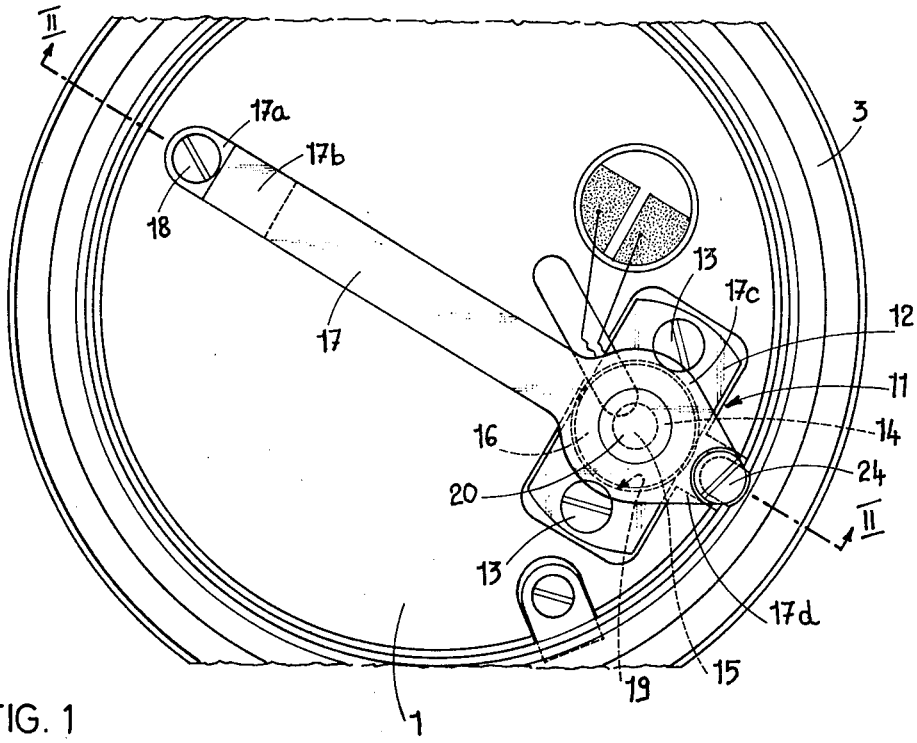
FIG. 1 is a plan view from above of an alarm wrist watch from which the plate of the case has been removed and FIG. 2 is a detailed cross section of this watch along line II—II of FIG. 1 in an enlarged scale.

The electro-mechanical wrist watch illustrated in the drawing includes a module or movement having a base 1 and a dial 2. This movement rests in a casing composed of main casing 3, plate 4, ring 5, and crystal or glass 6, the glass 6 being made of an extra hard material such as a hardened mineral glass.

Figure 2:
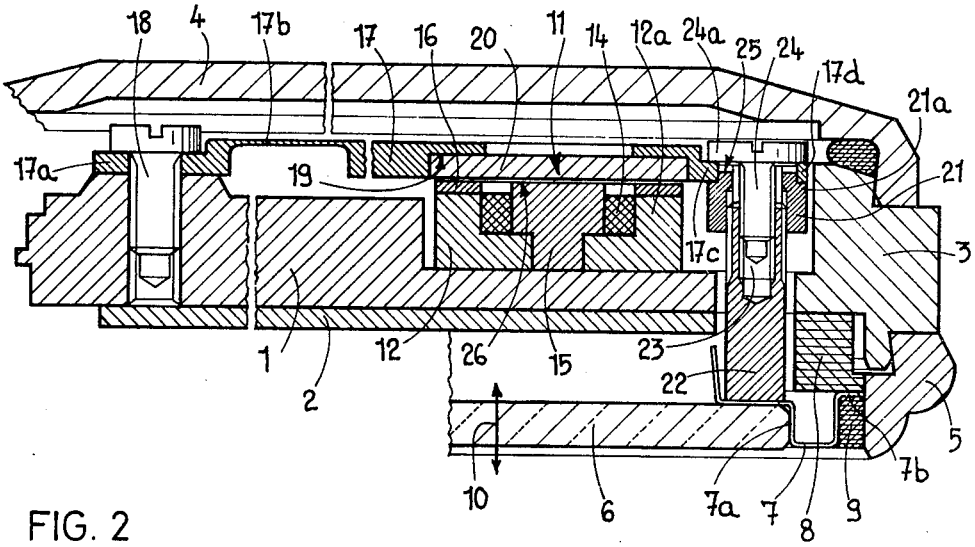

Glass 6 is the sound generating member for the alarm watch. For this purpose, it is elastically suspended by a thin ring 7 which has a cylindrical section **7*a* to which it is soldered. The ring 7 is in turn retained by ring 5, its edge 7*b* being trapped between two rings 8 and 9 which are held in position by the case sealing ring 5. In this configuration, glass 6 can move in the direction of arrow 10 in FIG. 2**, i.e. perpendicular to its surface.

The watch incorporates an electro-acoustic device which induces the vibration of glass 6. This device consists of a solenoid generally identified as item 11. Solenoid 11 includes a socket 12 made of a soft magnetic material, for example of a material known as VACOFER S2 (registered trademark) manufactured by VACUUM SCHMELTZE HANAU. This socket 12 is attached to the base 1 with screws 13 and features a raised section **12*a*. Section 12*a* forms a circular collar which accomodates a coil 14 through which a core 15 also made of VACOFER S2 penetrates or is located. The surface of collar 12*a* is covered by a ring-shaped polarization magnet 16** provided to increase the efficiency of the device.

The moving part or sound generating member of the device is coupled to a rigid oscillating lever 17 made of non-magnetic material, for example of aluminum. Lever 17 is attached to base 1 by a screw 18 through one of the ends of lever 17 marked **17*a*. This oscillating lever 17 has a tapered part 17*b* near its end 17*a* to allow elastic deformation of lever 17. This part 17*b* constitutes an articulation allowing the lever to oscillate at its fundamental frequency, i.e. the oscillation of lever 17** is free of harmonic frequencies which consume energy.

Lever 17 also has an enlarged part **17*c* located near its end opposite end 17*b* designated by 17*d* in which there is a circular recess 19 designed to hold a pellet-shaped component 20 made of soft magnetic material, for example of VACOFER S2. This pellet-shaped component faces solenoid 11** in a coaxial manner and acts as the armature of the solenoid.

The end **17*d* of the oscillating lever 17 is the point on the lever with the greatest amplitude, and it is at this end that the lever contacts glass 6 to produce the vibrations thereof. For this purpose, the end 17*d* of the lever has a hole which freely accomodates one end of a sleeve 21, with an external shoulder 21*a* that rests against the inside surface of lever 17. This sleeve 21 is threaded internally over part of its length and at the threaded end can receive a rod 22 whose other end is soldered to ring 7 which is used to mount glass 6. Rod 22 and sleeve 21 build or form together a stem. This stem, substantially perpendicular to the lever 17, transmits the oscillating motion of the lever 17 to the glass 6. The glass 6 being substantially parallel to the lever 17, it oscillates in the direction of arrow 10, i.e. perpendicular to its surface. The motion of the glass 6 thus reproduces with high fidelity the oscillating motion of the lever 17**.

Rod 22 has a tapped hole 23 with internal threads to accommodate screw 24, the head **24*a* of which rests on the opposite or top surface of lever 17. Sleeve 21 has a slotted end 25 and can thus be turned with a screwdriver. Due to this device, the useful length of sleeve 21 and of rod 22, i.e. of the stem, is adjustable; the adjustment can be made by turning sleeve 21 with a screwdriver when the device is installed in the watch and before screw 24 is inserted. The gap marked 26 (FIG. 2) between the pellet-shaped component 20 and the core 15 is thus adjustable. When the adjustment is made, screw 24 is positioned and tightened to assure fixation of sleeve 21 holding rod 22 on the end 17***d* of the oscillating lever 17 and simultaneously locking rod 22 with respect to the sleeve into which it is screwed.

The head of the adjusting means of the length of the stem is located on the back of the watch movement, thus allowing by the use of a screwdriver the adjustment of the useful length of sleeve 21 and rod 22 when the watch movement is mounted in the casing. In practice, in the manufacturing process, the device is activated and an operator, hearing the sound generated by the glass 6, can maximize it by acting on sleeve 21. When this operation is done, the magnetic circuit which comprises the solenoid 11, the socket 12, the coil 14, the core 15, the magnet 16, and the component 20 is adjusted; it is thus possible to get the maximum amount of work out of the electro-acoustic device.

The device according to the invention can accomodate any kind of glass and is particularly adapted for the use with scratchproof sapphire or mineral crystals.

We claim:

1. An electro-acoustic device, particularly for use with an alarm watch movement, comprising:

a base;

solenoid means mounted on said base for creating an oscillating electromagnetic field;

a lever having a flexible first end mounted on said base, a second end opposite said first end, and a portion including magnetic material located for cooperating with said field and for providing said second end with an oscillating motion while said magnetic material is actuated by said field;

sound generating means for generating sounds; and connecting means for rigidly connecting said second end of the lever and said sound generating means to transmit with fidelity the oscillations of the lever to the sound generating means.

2. The electro-acoustic device of claim 1, wherein said portion of the lever including magnetic material is located between said first end and said second end of the lever.

3. The electro-acoustic device of claim 1 or 2 wherein said first end of the lever includes an elastically deformable tapered part.

4. The electro-acoustic device of claim 1 or 2 wherein said lever is made of a non-magnetic material and includes a groove facing the solenoid means in which the magnetic material is inserted.

5. The electro-acoustic device of claim 1, wherein said connecting means include stem means having two ends, one end thereof being rigidly connected to said second end of the lever, the other end of said stem means being rigidly connected to said sound generating means, said stem means being substantially perpendicular to said lever.

6. The electro-acoustic device of claim 5 wherein said stem means are adjustable in length.

7. The electro-acoustic device of claim 1 in which said connecting means include stem means having two ends, one end thereof being rigidly connected to said second end of the lever and the other end of the stem being rigidly connected to the sound generating means and said stem being substantially perpendicular to the lever, the stem means being adjustable in length, the stem means including a rod with an externally threaded end and further including an internally tapped sleeve, there being a hole through the second end of the lever with said sleeve being freely engaged in the hole, the sleeve being screwed on the threaded end of the rod and the sleeve including means for being rotated by a tool to adjust the length of the stem means.

8. The electro-acoustic device as claimed in claim 7 wherein the threaded end of the rod includes a central internally tapped opening and in which there is a screw passing through said sleeve and being screwed into said opening to secure said rod in position with said sleeve.

9. The electro-acoustic device as claimed in claim 8 wherein said screw passes through said hole in the lever and the screw includes a head resting on one side of said lever, said sleeve including an exterior shoulder which rests on a surface of said lever opposite said one side of said lever.

* * * * *